US010597784B2

(12) United States Patent
McGee et al.

(10) Patent No.: US 10,597,784 B2
(45) Date of Patent: Mar. 24, 2020

(54) COLD SPRAY NOZZLE

(71) Applicant: United Technologies Corporation, Farmington, CT (US)

(72) Inventors: Randolph C. McGee, Hamden, CT (US); Aaron T. Nardi, East Granby, CT (US)

(73) Assignee: United Technologies Corporation, Farmington, CT (US)

( * ) Notice: Subject to any disclaimer, the term of this patent is extended or adjusted under 35 U.S.C. 154(b) by 301 days.

(21) Appl. No.: 15/652,782

(22) Filed: Jul. 18, 2017

(65) Prior Publication Data

US 2019/0024241 A1 Jan. 24, 2019

(51) Int. Cl.

| | |
|---|---|
| ***C23C 24/04*** | (2006.01) |
| ***B05B 7/20*** | (2006.01) |
| ***B05B 15/18*** | (2018.01) |

(52) U.S. Cl.

CPC ..... *C23C 24/04* (2013.01); *B05B 7/205* (2013.01); *B05B 15/18* (2018.02)

(58) Field of Classification Search

CPC ..... C23C 24/04; B05B 7/205; B05B 7/206; B05B 15/18

See application file for complete search history.

(56) References Cited

U.S. PATENT DOCUMENTS

| | | | | |
|---|---|---|---|---|
| 4,749,630 | A | 6/1988 | König et al. | |
| 5,302,414 | A | 4/1994 | Alkhimov et al. | |
| 6,478,887 | B1 | 11/2002 | Sue et al. | |
| 7,543,764 | B2 * | 6/2009 | Haynes | B05B 1/00 239/601 |
| 7,621,466 | B2 * | 11/2009 | Ko | B05B 7/1486 239/398 |
| 8,815,023 | B2 | 8/2014 | Zlatev et al. | |
| 9,556,531 | B2 | 1/2017 | Erdemir et al. | |
| 2010/0151124 | A1 | 6/2010 | Xue et al. | |
| 2010/0181391 | A1 | 7/2010 | Gärtner et al. | |
| 2013/0087633 | A1 | 4/2013 | Fukanuma | |
| 2013/0327856 | A1 * | 12/2013 | Fukanuma | C23C 24/04 239/601 |
| 2015/0203980 | A1 | 7/2015 | Erdemir et al. | |
| 2016/0221014 | A1 | 8/2016 | Nardi et al. | |

(Continued)

FOREIGN PATENT DOCUMENTS

| | | | |
|---|---|---|---|
| EP | 0807470 | A1 | 11/1997 |
| EP | 2278162 | A1 | 1/2011 |
| EP | 2657368 | A1 | 10/2013 |

OTHER PUBLICATIONS

European Search Report dated Dec. 17, 2018 for European Patent Application No. 18173168.8.

(Continued)

*Primary Examiner* — Darren W Gorman

(74) *Attorney, Agent, or Firm* — Bachman & LaPointe, P.C.

(57) ABSTRACT

A spray nozzle has a body having a flow passage. At least along a portion of the flow passage the body has a depth-wise compositional variation having: a cemented carbide first region; and a cemented carbide second region closer to the flow passage than the first region and having a higher boron content than a boron content, if any, of the first region.

20 Claims, 5 Drawing Sheets

(56) References Cited

U.S. PATENT DOCUMENTS

2016/0222520 A1 8/2016 Kennedy et al.

OTHER PUBLICATIONS

Phuong Vo et al., Cold-Spray Processing of Titanium and Titanium Alloys, Titanium Powder Metallurgy, Feb. 2015, p. 405-423, Elsevier, Inc., the Netherlands.

Tobias Schmidt et al., From Particle Acceleration to Impact and Bonding in Cold Spraying, Dec. 2009, p. 794-808, ASM International—Journal of Thermal Spray Technology, Materials Park, Ohio.

T. Hussain et al., Corrosion Behavior of Cold Spray Titanium Coatings and Free Standing Deposits, Oct. 2011, p. 260-274, ASM International—Journal of Thermal Spray Technology, Materials Park, Ohio.

Xudong Wang et al., Investigation on the Clogging Behavior and Additional Wall Cooling for the Axial-Injection Cold Spray Nozzle, Apr. 2015, p. 696-701, ASM International—Journal of Thermal Spray Technology, Materials Park, Ohio.

H. Fukanuma et al., Simulation of Cold Spray Nozzle Accompanying a Water-Cooling Adjustment, Jan. 2011, Plasma Giken Co., Saitama, Japan.

Jamin M. Johnston et al., Metal-Boride Phase Formation on Tungsten Carbide (WC—Co) During Microwave Plasma Chemical Vapor Deposition, Applied Surface Science, Feb. 2016, p. 315-321, Elsevier, B.V., the Netherlands.

Material Product Data Sheet, Tungsten Carbide 12% Cobalt+Self-Fusing Nickel Alloy Thermal Spray Powder Blends, Aug. 2014, Oerlikon Metco, Pfäffikon, Switzerland.

High-Performance Solid Carbide Round Tools, 2014 Catalog, Oct. 2013, Ultra-Tool International, Inc., Huntington Beach, California.

* cited by examiner

COLD SPRAY NOZZLE

U.S. GOVERNMENT RIGHTS

This invention was made with Government support under contract W9111NF-14-2-0011 awarded by the United States Army. The Government has certain rights in this invention.

BACKGROUND

The disclosure relates to spray deposition/coating. More particularly, the disclosure relates to cold spray nozzles.

The cold spray process is an important technology in the areas of additive manufacturing, repair, and functional coatings. It is characterized by "layer by layer" deposition build-up of material at a substrate surface by high speed impact of solid particles. The basic cold spray process involves the flow of a pressurized gas (e.g., nitrogen, helium, air, argon, hydrogen, and the like) through a gas heater (e.g., heating to between room temperature and 1000° C. effective to impart desired plasticity to the powder). Powder is injected into the heated gas stream and the powder-gas mixture is then accelerated through a de-laval type nozzle (e.g. converging-diverging) and then discharged at a substrate resulting in deposition and consolidation of the material.

Cold spray typically does not involve melting of the powder feedstock. Rather, the heating of the carrier gas combined with the high velocity (and thus kinetic energy) of particles produces highly plastic behavior of the particles on impact with the substrate and then with already-sprayed material (e.g., prior layers of the cold spray). Depending on the particular coating material and end use, artifacts of cold spray may have various benefits. These artifacts include: work hardening during impact; beneficial compressive residual stresses in the spray deposits; unique microstructures (nano-grained, multiphase materials, etc.); retention of feedstock microstructure (unlike high temperature deposition techniques (high velocity oxy-fuel (HVOF), plasma spray, etc.); and, despite the lack of melting, near 100% density if desired.

Exemplary apparatus and nozzles therefor are disclosed in United States Patent Application Publications 20160221014 A1 (the '014 publication of Nardi; Aaron T. et al., Aug. 4, 2016) and 20160222520 A1 (the '520 publication of Kennedy; Matthew B. et al., Aug. 4, 2016), the disclosures of which publications are incorporated by reference in their entireties herein as if set forth at length.

The nozzle can be made from many materials depending on the powder material being deposited, but often is cemented carbide for robustness/durability. Although the cold spray process has received considerable attention, it does however exhibit a critical drawback. Quite often, the powder material quickly clogs the nozzle resulting in fouling, poor deposits, and disruption of the process. X. Wang, B. Zhang, J. Lv, and S. Yin, "Investigation on the Clogging Behavior and Additional Wall Cooling for the Axial-Injection Cold Spray Nozzle", Journal of Thermal Spray Technology, Feb. 25, 2015, Vol. 24 (4), pp. 696-701, Springer Science+Business Media LLC, New York, N.Y. When using typical spray powders (e.g., nickel, copper, titanium and their respective alloys) clogging can occur in as little as a few minutes, but is highly dependent on the spray process conditions and gases being used. For instance, using helium at high pressure and with high gas temperatures produces the highest particle velocities and, for many important powders, the best properties, but these instances result in the highest likelihood for clogging. The nozzle clogging may relate to adhesion mechanisms in tribological applications. Cobalt is the soft phase in the WC—Co nozzle and it is likely that powders adsorb on the Co phase during spraying.

Such clogging results in lost time and additional material cost due to frequent nozzle repair and replacement. It is due partly to this issue that extensive, long-duration industrial cold-spray processes have not yet been established.

SUMMARY

One aspect of the disclosure involves a spray nozzle comprising a body having a flow passage. At least along a portion of the flow passage, the body has a depth-wise compositional variation comprising: a cemented carbide first region; and a cemented carbide second region closer to the flow passage than the first region and having a higher boron content than a boron content, if any, of the first region.

A further embodiment of any of the foregoing embodiments may additionally and/or alternatively include the flow passage being converging-diverging.

A further embodiment of any of the foregoing embodiments may additionally and/or alternatively include the first region having a weight percent composition of: at least 80 percent tungsten carbide; at least 5.0 percent cobalt; no more than 0.1 percent boron, if any; and other elements, if any, no more than 1.0 percent total and no more than 0.75 percent individually.

A further embodiment of any of the foregoing embodiments may additionally and/or alternatively include the second region having a boron content of at least 0.2 weight percent higher than a boron content of the first region, if any.

A further embodiment of any of the foregoing embodiments may additionally and/or alternatively include the second region having a boron content of at least 1.0 weight percent higher than a boron content of the first region, if any.

A further embodiment of any of the foregoing embodiments may additionally and/or alternatively include the second region having a boron content of at least 0.2 weight percent.

A further embodiment of any of the foregoing embodiments may additionally and/or alternatively include a boron content at a depth in the second region being 1.0 weight percent to 10.0% weight percent.

A further embodiment of any of the foregoing embodiments may additionally and/or alternatively include a cold spray apparatus including the spray nozzle and further comprising a powder source and a carrier gas source.

A further embodiment of any of the foregoing embodiments may additionally and/or alternatively include the cold spray apparatus further comprising a heater for heating the carrier gas.

A further embodiment of any of the foregoing embodiments may additionally and/or alternatively include a method for manufacturing the spray nozzle. The method comprises: placing a boriding powder into a passageway of a cemented carbide precursor of the spray nozzle; and heating the precursor so as to diffuse boron from the boriding powder into the precursor.

A further embodiment of any of the foregoing embodiments may additionally and/or alternatively include the cemented carbide precursor having at least 70% WC by weight.

A further embodiment of any of the foregoing embodiments may additionally and/or alternatively include the cemented carbide precursor having at least 4.0% combined Ni and Co by weight.

A further embodiment of any of the foregoing embodiments may additionally and/or alternatively include the cemented carbide precursor having one or more: at least 6.0% combined Ni and Co by weight; up to 5.0% TaC, if any, by weight; up to 5.0% total other, if any by weight; and up to 2.0% individually other, if any, by weight.

A further embodiment of any of the foregoing embodiments may additionally and/or alternatively include forming the precursor by machining the passageway.

A further embodiment of any of the foregoing embodiments may additionally and/or alternatively include the boriding powder comprising least 10 wt % B and 5.0 wt % $KBF_4$.

A further embodiment of any of the foregoing embodiments may additionally and/or alternatively include the heating being to at least 850° C.

A further embodiment of any of the foregoing embodiments may additionally and/or alternatively include the heating being to 850° C. to 1000° C.

A further embodiment of any of the foregoing embodiments may additionally and/or alternatively include a method for using the spray nozzle. The method comprises: flowing a powder and a carrier gas through the nozzle; and directing a spray of the powder from the nozzle to a substrate.

A further embodiment of any of the foregoing embodiments may additionally and/or alternatively include heating the carrier gas.

A further embodiment of any of the foregoing embodiments may additionally and/or alternatively include the powder comprising at least one of: ceramic particles; and metallic particles.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

The internal surface of a WC—Co cold spray nozzle may be modified via boronization (boriding). Boriding is a thermochemical treatment technique by which boron atoms diffuse into the surface of a substrate to form borides with the base metal(s). During boriding, the diffusion and subsequent absorption of boron atoms into the metallic lattice of a surface region of the component form interstitial boron compounds. The resulting layer may be either a single-phase or a poly-phase boride layer.

Figure 1:
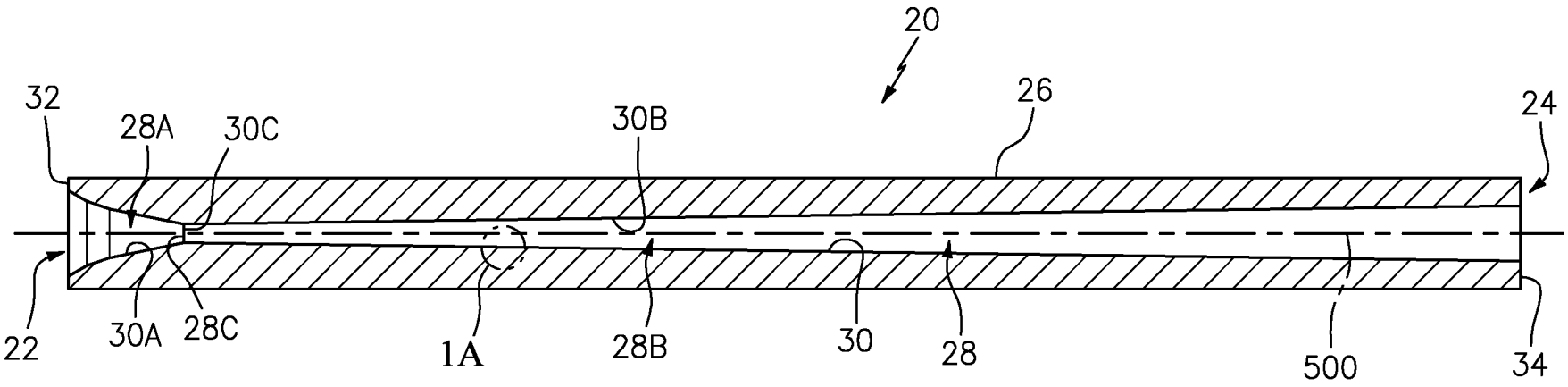
FIG. 1 is a central longitudinal sectional view of a cold spray nozzle.

FIG. 1 shows a nozzle 20 extending from an upstream/proximal/inlet end 22 to a downstream/distal/outlet end 24. The nozzle has an exterior lateral surface 26 extending between the ends. The exemplary nozzle has a central longitudinal axis 500. The exemplary exterior lateral surface 26 is a circular cylindrical surface centered on the axis 500. A central passageway 28 defined/bounded by an interior surface 30 extends between the ends. The exemplary passageway is of varied circular cross-section centered on the axis 500, leaving annular rims 32 and 34 at the respective ends 22 and 24. The nozzle may be used in apparatus and with methods such as those disclosed in the '014 and '520 publications or otherwise. Exemplary use fields include gas turbine engine component coatings which may involve metallic and/or ceramic powder feedstocks and particularly with ceramic or combinations may further include polymeric fugitive porosity formers.

In the exemplary converging-diverging nozzle, the passageway 28 and surface 30 have an upstream portion 28A, 30A converging in a downstream direction and a downstream portion 28B, 30B diverging in a downstream direction. They similarly have a throat 28C, 30C shown as a single axial position. Alternative throats may be constant diameter zones of non-zero length.

Figure 1A:
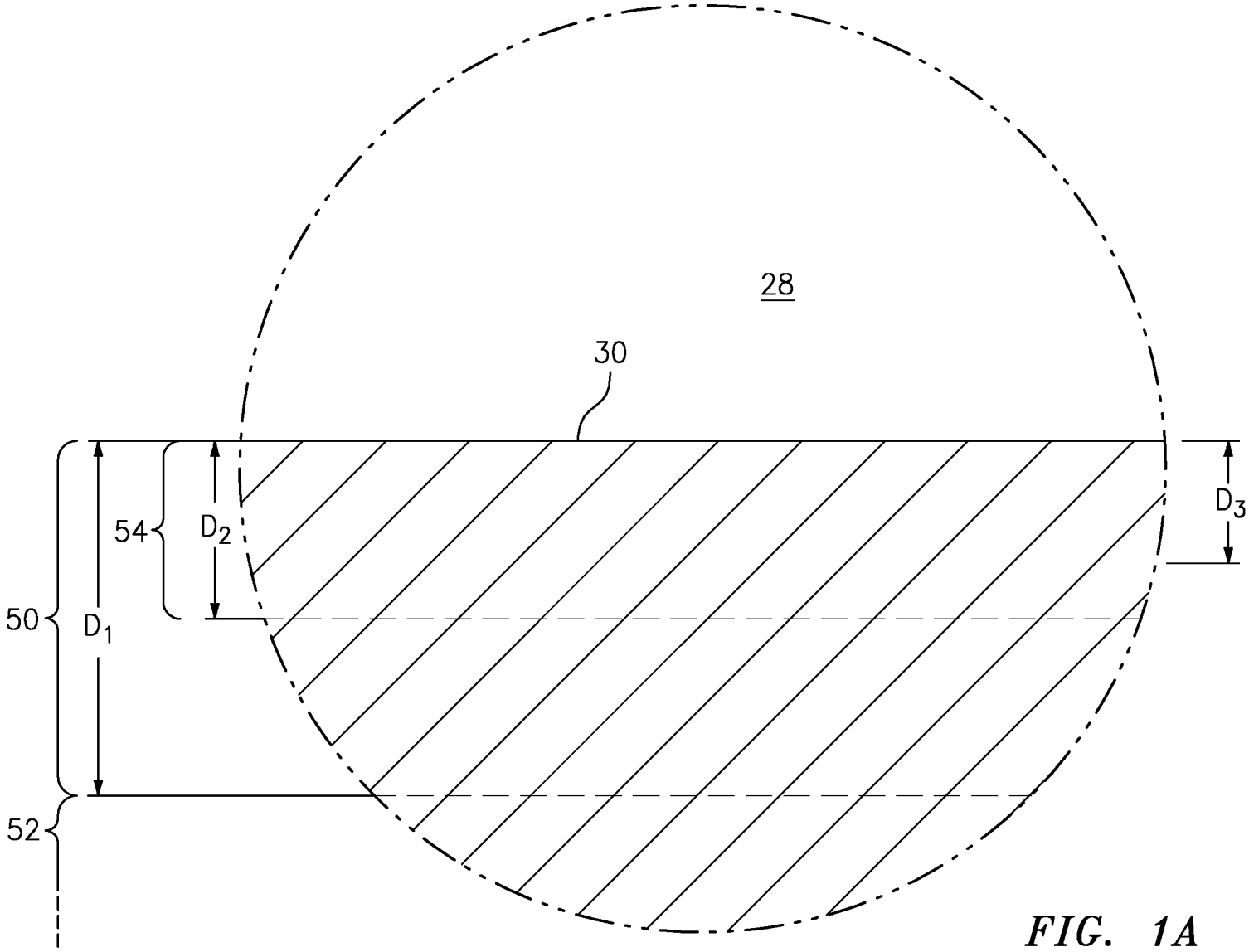
FIG. 1A is an enlarged view of an interior surface region of the nozzle of FIG. 1.

FIG. 1A shows the nozzle metallic substrate as including a depth-wise region 50 affected by the boriding and an undisturbed region 52 therebelow. Within the region 50, a smaller depth-wise surface region 54 has a more substantial degree of boriding. FIG. 1A shows the regions 50 and 54 having respective depths $D_1$ and $D_2$ from the local surface 30. Based on known boriding of other materials (namely, borided steels), estimated $D_1$ is broadly in the range of 25 micrometers to 400 micrometers and estimated $D_2$ is about 25% to 50% of $D_1$ The boron enters the surface of the material through a diffusion mechanism and slowly diffuses at temperature into the material thus producing a graded boron concentration highest near the surface 30 and reducing with depths into the depth of the WC—Co material. The concentration of boron, and the depth of boron as well as the boron containing species within the material produced are governed by the pack material selected, the temperature used, and the time at which the part is held at temperature.

The basic WC—Co nozzle may be manufactured by machining (e.g., on a grinding machine or via EDM) from WC—Co rod stock (e.g., potentially preserving the exterior lateral surface 26 as the outer diameter (OD) surface of as-received circular rod stock). The exemplary circular cylindrical nozzle may be mounted in the associated spray gun via a compression gasket/fitting. Alternative nozzles may have dedicated mounting features such as threads, bayonet features, flanges, and the like.

In general, the advantages associated with boriding on nickel- and cobalt-based articles such as high temperature bearings may include one or more of: 1) boride layers have extremely high hardness (higher than other conventional diffusion-type methods such as carburizing or nitriding); 2) boride layers reduce coefficient of friction (high surface hardness and low coefficient of friction increase wear resistance and surface fatigue resistance); 3) boriding hardness can be maintained at higher temperatures than other techniques (e.g., carburizing and nitriding); 4) boride layers considerably enhance corrosion resistance; 5) boride layers moderately enhance oxidation resistance; and 6) boride layers have high resistance to molten metals. A combination of these can result in increased fatigue life, wear life, and service performance under oxidizing and corrosive environments.

Powder pack boriding is the most widely used boriding process. This is mostly due to easy handling and simple exchanging of the boriding powder, low cost, and no need for complex equipment. The method typically involves packing and heating a metal piece in a powder comprising or consisting of a boron carbide mixture diluted with a refractory material such as SiC and a boron fluoride component (e.g., $KBF_4$, $NaBF_4$, and/or $NH_4BF_4$). An exemplary commercially available SiC boriding powder has a weight percent content of 74.9 SiC, 16.8 B, 8.3 $KBF_4$. The B may be present largely as $B_{12}$ icosahedra. More broadly, exemplary powder has at least 10 wt % B and 5.0 wt % $KBF_4$.

Any of numerous existing or yet-developed pack boriding techniques and associated apparatus may be used to boride the internal surface of cold spray nozzles. In one or more embodiments, the boriding may improve powder flow properties, optimize process conditions, and/or prevent/retard nozzle clogging/fouling. Boriding can potentially improve powder flow properties. Process optimization can be achieved by boriding due making it feasible to adjust spray parameters (e.g., facilitating use of helium at high temperatures and thus faster velocities). Lastly, the cobalt is the "soft-phase" in the WC—Co nozzle. During cold spray, it is likely that powders adsorb on the cobalt. Thus, by boriding and forming $Co_3B$ and $CO_2B$ phases on the nozzle, the adhesion of powders to the surface may be reduced or eliminated. Additionally, the adhesion mechanism in tribology is almost directly related to surface hardness which corresponds with the increase in Vickers hardness following the boriding process.

Exemplary pre-boriding nozzle substrate composition is, in weight percent 90 percent WC and 10 percent Co, with well under 1.0 percent total of other elements, if any. More broadly, the pre-boriding weight percent composition may be 87 percent to 93 percent tungsten carbide; 6.0 percent to 13.0 percent cobalt; essentially boron-free (e.g., no more than 0.1 percent boron, if any; and other elements no more than 1.0 percent total and no more than 0.75 percent individually, if any. Yet more broadly, the pre-boriding weight percent composition may be at least 85 percent tungsten carbide; at least 5.0 percent cobalt; no more than 0.5 percent boron, if any; and other elements no more than 1.25 percent total and no more than 0.85 percent individually, if any. Yet more broadly, the pre-boriding weight percent composition may be at least 80 percent tungsten carbide; at least 4.0 percent cobalt; no more than 1.0 percent boron, if any; and other elements no more than 1.5 percent total and no more than 0.95 percent individually, if any. These numbers are for essentially pure WC—Co materials. Even starting with such material, additional contaminants may be introduced such as from electrodes used in electro-discharge machining. Such contaminants typically include copper. Also, there may be a tendency to draw certain elements from the substrate toward the surface, particularly carbon.

For instance, the WC—Co boride pellets used in testing were machined from six-inch long WC—Co rods of the same diameter. The pellets were prepared from polished ground WC—Co (10% Co) rods. The rods were cut into half-inch diameter quarter-inch thick pellets using a copper electrical discharge machining (EDM) Sodick AG400L wire cutter. A standard 0.010 inch diameter brass wire was used along with carbide settings with low flushing followed by the use of a commercial scouring pad to remove the recast layer. This type of method, which is also used for machining cold spray nozzles can often result in significant surface contamination. Particularly, at the surface (e.g. for less than about 50 nanometers, there was a predominance of C (drawn from the substrate), tailing off through an end of measurement at about 150 nanometer. However, Cu actually increased over this range.

Other WC-based cemented carbide materials commercially available include those using Ni as a binder. For example, commercial WC—Ni typically have about 6% to 12% nominal nickel by weight. Variants may substitute small amounts of TaC (e.g., up to 4% nominal by weight in commercial grades) for some of the WC. Some commercial grades of the various carbides also list 1% other by weight for proprietary additions. Thus, components other than those listed may easily aggregate to 5% or individually be up to 2% by weight for the pre-processing alloys Post-boriding a depth-wise surface region (e.g., the FIG. 1A region 54 extending from the surface to depth $D_2$) may have a total (average) bulk boron content of at least 0.2 weight percent which includes boron present in mono and polyphase boride compounds. At a reference depth $D_3$ (e.g., a particular reference depth selected within the broader region 50 of depth $D_1$ or the narrower region 54 of depth $D_2$) such as 0.07 micrometer to 0.10 micrometer, the boron content may be 1.0 weight percent to 3.0 weight percent. More broadly, post-boriding, at a depth $D_3$ of 0.05 micrometer to 0.5 micrometer, the boron content may be 1.0 weight percent to 10.0 weight percent.

Below a depth $D_1$, the composition may essentially be unchanged from pre-boriding.

Figure 2:
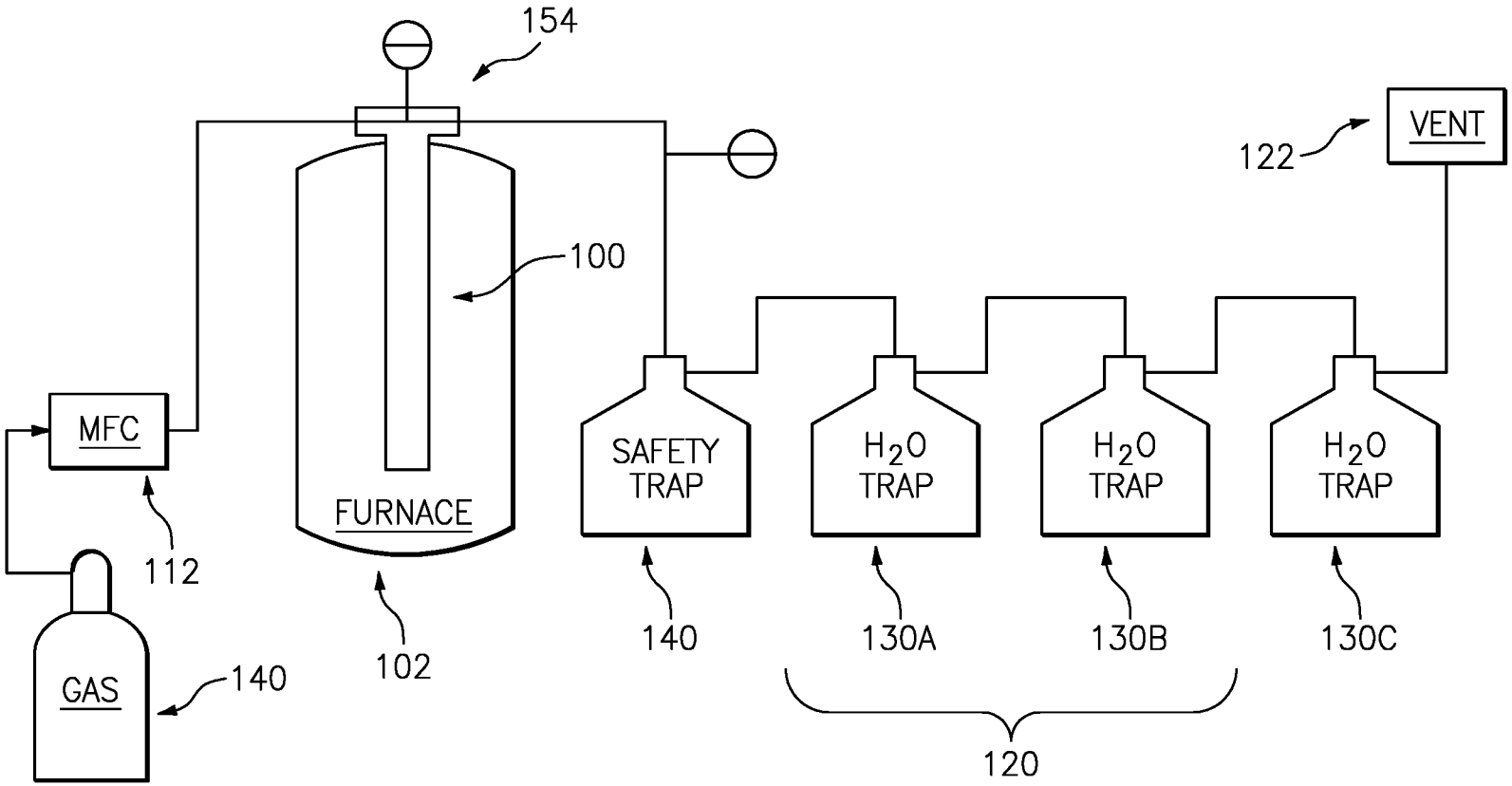
FIG. 2 is a schematic view of a boriding system.

An exemplary test scale boriding system comprises a reactor vessel for containing the reaction, means for heating, a gas supply, and means for evacuating and cleaning the gas. FIG. 2 shows the reactor vessel 100 as a tubular reactor extending downwardly into the interior of a furnace 102 (e.g., a commercial clam shell furnace with 16 inches of heated zone) which serves as the heating means. The gas serves as an inerting blanket to the boriding reaction. Exemplary gas is Ar. Alternative gas is $N_2$. The exemplary gas source comprises a tank 110 of pressurized gas or its liquid form and a mass flow controller (MFC) 112 along a supply line and flowpath from the tank to the reactor.

For evacuating and cleaning the gas, a multi-stage trap system 120 may be located along a discharge flowpath to an outlet or vent 122 (e.g., to atmosphere or to a collection system (not shown—such as a compressor feeding a collection tank). The exemplary traps include liquid traps (e.g., deionized (DI) water traps) 130A, 130B, 130C in series to capture any fluorine or fluoride containing by-products produced by the decomposition of the boriding powder. Each exemplary trap is formed as vessel containing a body of the liquid with a sealed top housing two ports, one inlet, and one outlet. The inlet port communicates with a tube extending into the vessel and into the liquid. The outlet port communicates with the headspace to allow the gas above the liquid to flow out of the vessel. In this way the gasses from the process bubble through the liquid, where the liquid can trap some of the species such as the fluorine, potassium, etc., then allow the gas to bubble to the top of the liquid where it can then escape though the outlet.

An empty safety trap vessel 140 may be included between the reactor and liquid traps to prevent potentially drawing the liquid from the traps into the reaction vessel in the event of a loss of supply gas and cooling of the reactor. This may be of similar construction to the liquid traps but just lacking the liquid and connected in the reverse manner with respect to the flow path of the gasses (i.e., the outlet gas from the reactor would enter the inlet of the safety trap which would enter the gasses into the top of the safety trap then go out of the exit through a tube that extends from the sealed cover down into the safety trap to a similar depth as the inlets to the liquid-filled traps).

The exemplary reactor is formed generally as a T, with the arms of the T respectively coupled to the gas supply line and gas discharge line and the leg of the T extending downward into the furnace and having a closed lower end. In operation, the leg contains the nozzle and boriding powder.

Figure 3:
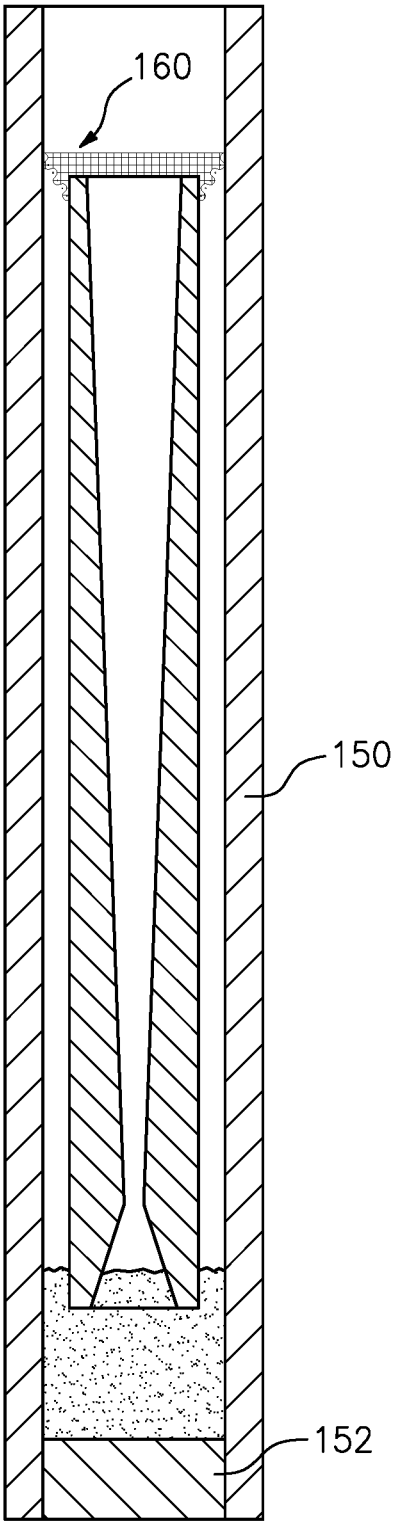
FIG. 3 is a central longitudinal sectional view of a nozzle in a reactor tube of a reactor of the system of FIG. 2.

The exemplary reactor may be made of stainless steel pipe and fittings (e.g., 316 stainless steel). An exemplary test reactor comprised a 14-inch long, 1-inch OD×0.49-inch wall stainless steel tube 150 (FIG. 3). At its lower end, the tube was closed by a ⅝-inch OD 316 stainless steel plug 152. Its upper end was removeably closable by mating with the leg of a 7.5-inch long (armspan) stainless steel tee fitting (not shown) providing the inlet and the outlet to the T reactor. Conventional pipe/tubing fittings may be used to construct the T reactor.

In addition, three skin thermocouples (not shown) were tack-welded to the outside surface of the tube at ~2.0 inches, 3.875 inches, and 4.5 inches from the lower end of the 14-inch tube, leaving approximately 10.375 inches of heated reaction zone within the furnace.

In order to boride the internal surface of the exemplary 8-inch long converging-diverging cold spray nozzle, the nozzles were packed with the boriding powder while positioned within the leg of the T and the tee removed.

A stainless steel mesh support ring 160 was made to secure the nozzle during loading. The ring was formed as an annulus of slightly smaller ID than nozzle OD and slightly larger OD than pipe ID. Once the ring was fitted around the top portion of the nozzle, the nozzle and ring were loaded into the boriding reactor with the bottom 1 inch of the nozzle placed in a bed of boriding powder while the nozzle/reactor combination was placed on an electric agitator to ensure adequate dense packing. Further boriding powder was introduced (e.g., via funnel and spatula) into the open upper end of the nozzle until full. The nozzle was vibrated during this time and there was no need for tamping. Then the tee was attached. The ring remained in position during the boriding reaction and was easily removed by hand during unloading of the reactor.

The powder was a commercially available SiC boriding powder having a weight percent content of 74.9 SiC, 16.8 B, 8.3 $KBF_4$. The B may be present largely as $B_{12}$ icosahedra. Exemplary powder has at least 3.9 B and 5.0 $KBF_4$ by weight percent/

A test system as discussed above was used to boride the 8-inch long by 0.5 inch outer diameter nozzle. A similar but smaller reactor was used to boride smaller cylindrical test coupons (pellets) for subsequent chemical analysis. Both the nozzle and coupons were, in weight percent 90 percent WC and 10 percent Co. The commercial boriding powder noted above was used.

Figure 4:
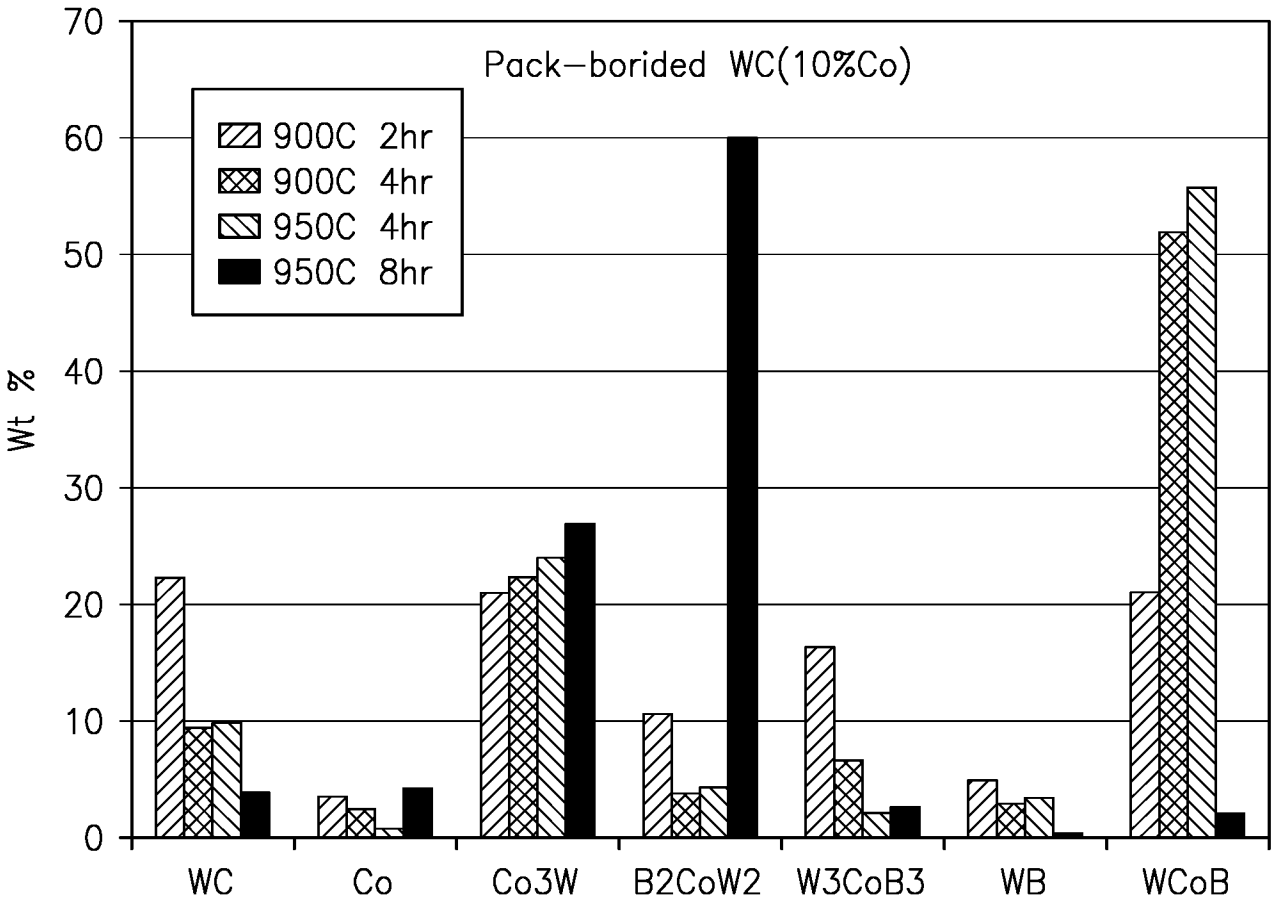
FIG. 4 is a chart of surface species on pack borided test coupons of various boriding temperatures and times.

The diffusion of boron into to the WC—Co coupon substrate and formation of metal-boride phases occurred when the WC coupons were packed with the boriding powder and reacted at temperatures between 900° C. and 950° C. This is shown by the identification of $Co_3W$, $B_2CoW_2$, $W_3CoB_3$, WB, and WCoB phases by XRD. FIG. 4 provides a summary of the respective concentrations of the boride species. The formation of these boride phases likely contributed to an increase in surface hardness which is expected to contribute to the elimination of nozzle clogging by powders during cold spray. The pack process resulted in an increase in Vickers hardness of the WC—Co material from 2032 HV as-received, to 2114 HV and 2363 HV following pack boriding for 4 hours at 900° C. and 950° C., respectively. The data also shows that the treatment at 900° C. actually increased the hardness of the WC—Co alloy, to a value slightly above the expected theoretical value. This is based on the relative contents and published hardness of WC 2242HV, Co 1043HV, $Co_3B$ 1152HV, and $Co_2B$ 1152HV.

An 8-hour 950° C. boriding actually reduced hardness to 1700 HV. This highlights that not only is there the possibility of diminishing return on boriding time, there may be a negative return.

These reaction conditions were also carried out to boride the converging-diverging WC—Co nozzles at 900° C. for 4 hours. The nozzles were then used for cold spray deposition of 4-8 um AEE Ni-110 (99.9% purity Ni) under helium flow at 30 bar and 450° C. From prior trials, this material and spray condition is known to result in almost immediate clogging and was a good test case for this concept. The boriding of the nozzles was shown to significantly reduce clogging during cold spray deposition of the nickel powder allowing for a complete test coupon to be produced through 5 minutes of continuous spraying. Previously the same powder had clogged immediately not allowing a coupon to be produced at this same spray condition. This confirms the effectiveness of the nozzle boriding approach. The boriding may be combined with other methods known in the art including nozzle cooling or yet-developed aspects to greatly extend the possible spray times for materials and spray conditions prone to clogging.

The testing with Ni serves as a good proxy for other Ni-based alloys.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline nozzle and/or gun configuration and process, details of such baseline may influence details of particular implementations. Accordingly, other embodiments are within the scope of the following claims.

What is claimed is:

1. A spray nozzle comprising:

a body having a flow passage, wherein at least along a portion of the flow passage the body has a depth-wise compositional variation comprising:

a cemented carbide first region; and a cemented carbide second region closer to the flow passage than the first region and having a higher boron content than a boron content, if any, of the first region.

2. The spray nozzle of claim 1 wherein:

the flow passage is converging-diverging.

3. The spray nozzle of claim 1 wherein the first region has a weight percent composition of:

at least 80 percent tungsten carbide;

at least 5.0 percent cobalt;

no more than 0.1 percent boron, if any; and other elements, if any, no more than 1.0 percent total and no more than 0.75 percent individually.

4. The spray nozzle of claim 1 wherein the second region has a boron content of at least 0.2 weight percent higher than a boron content of the first region, if any.

5. The spray nozzle of claim 1 wherein the second region has a boron content of at least 1.0 weight percent higher than a boron content of the first region, if any.

6. The spray nozzle of claim 1 wherein the second region has a boron content of at least 0.2 weight percent.

7. The spray nozzle of claim 1 wherein:

a boron content at a depth in the second region is 1.0 weight percent to 10.0% weight percent.

8. A cold spray apparatus including the spray nozzle of claim 1 and further comprising:

a powder source; and a carrier gas source.

9. The cold spray apparatus of claim 8 further comprising:

a heater for heating the carrier gas.

10. A method for manufacturing the spray nozzle of claim 1, the method comprising:

placing a boriding powder into a passageway of a cemented carbide precursor of the spray nozzle; and heating the precursor so as to diffuse boron from the boriding powder into the precursor.

11. The method of claim 10 wherein:

the cemented carbide precursor has at least 70% WC by weight.

12. The method of claim 11 wherein:

the cemented carbide precursor has at least 4.0% combined Ni and Co by weight.

13. The method of claim 11 wherein the cemented carbide precursor has one or more:

at least 6.0% combined Ni and Co by weight;

up to 5.0% TaC, if any, by weight;

up to 5.0% total other, if any by weight; and up to 2.0% individually other, if any, by weight.

14. The method of claim 10 further comprising:

forming the precursor by machining the passageway.

15. The method of claim 10 wherein:

the boriding powder comprises least 10 wt % B and 5.0 wt % $KBF_4$.

16. The method of claim 10 wherein:

the heating is to at least 850° C.

17. The method of claim 10 wherein:

the heating is to 850° C. to 1000° C.

18. A method for using the spray nozzle of claim 1, the method comprising:

flowing a powder and a carrier gas through the nozzle; and directing a spray of the powder from the nozzle to a substrate.

19. The method of claim 18 further comprising:

heating the carrier gas.

20. The method of claim 18 wherein the powder comprises at least one of:

ceramic particles; and metallic particles.

* * * * *